US007368649B2

(12) United States Patent
Mintz

(10) Patent No.: US 7,368,649 B2
(45) Date of Patent: May 6, 2008

(54) METHOD AND DEVICE FOR ADJUSTING CYMBAL SOUND

(76) Inventor: Richard Mintz, 253 Collins Ave., Williston Park, NY (US) 11596-1023

( * ) Notice: Subject to any disclaimer, the term of this patent is extended or adjusted under 35 U.S.C. 154(b) by 148 days.

(21) Appl. No.: 11/333,728

(22) Filed: Jan. 17, 2006

(65) Prior Publication Data

US 2007/0163424 A1 Jul. 19, 2007

(51) Int. Cl.
*G10D 13/08* (2006.01)

(52) U.S. Cl. ..... 84/402; 84/422.3

(58) Field of Classification Search ..... 84/402, 84/422.1, 422.2, 422.3
See application file for complete search history.

(56) References Cited

U.S. PATENT DOCUMENTS 4,776,254 A 10/1988 Cruz
4,899,635 A * 2/1990 Santangelo ..... 84/411 M
5,637,819 A 6/1997 Rogers
5,877,440 A * 3/1999 Chaffee et al. ..... 84/411 M
5,922,980 A 7/1999 Arteaga
5,959,227 A 9/1999 Shapiro
6,686,528 B1 2/2004 Dicken
6,720,491 B1 * 4/2004 Kroncke ..... 84/422.3
2003/0158336 A1 * 8/2003 Yaguchi et al. ..... 525/95
2006/0065099 A1 * 3/2006 Anderson ..... 84/411 M
2007/0012535 A1 * 1/2007 Matheny ..... 188/378

* cited by examiner

*Primary Examiner*—Lincoln Donovan
*Assistant Examiner*—Jianchun Qin
(74) *Attorney, Agent, or Firm*—Richard L. Strauss, Esq.

(57) ABSTRACT

A method of optimizing the sound produced by a musical cymbal is disclosed wherein at least one segment including sound absorbing material having a specific, predetermined shape and thickness is applied to a mapped surface of a cymbal in order to alter the volume, frequency and duration of sound produced therefrom. In a second embodiment, a segment including vibration damping material having a specific, predetermined shape and thickness is applied to a mapped surface of a cymbal in order to alter the volume, frequency and duration of sound produced therefrom. Also disclosed is a cymbal having surface location markings so as to produce a mapped cymbal allowing precise identification and recording of the location where the aforementioned segments are placed. The at least one segment is affixed to varying positions and in varying amounts in order to obtain desired sound output from the cymbal to which they are affixed.

30 Claims, 8 Drawing Sheets

METHOD AND DEVICE FOR ADJUSTING CYMBAL SOUND

TECHNICAL FIELD

The disclosed method and device relate to the art and science of musical sound production. More specifically, the disclosed method and device provide a method and means of adjusting the sound quality and output of a cymbal which enables both consistent, repeatable cymbal tuning while also facilitates adapting cymbal sound production to any given performance environment.

BACKGROUND OF THE ART

Cymbal sound quality is effected by instrument size (diameter and thickness), shape, weight, construction and material composition. For example, increasing the diameter of a cymbal generally increases the volume and broadens the frequency of sound produced thereby. For example, a cymbal demonstrating a larger diameter (than another otherwise identical cymbal demonstrating the same thickness, weight, construction and material composition), will demonstrate a slower decay rate. Conversely, a cymbal demonstrating a smaller diameter will generally demonstrate a relatively faster rate of sound decay. Forming circumferential edges with irregular patterns such as, for example, wave-like configurations, can be an effective means of producing a cutting sound while shortening the sound duration of a cymbal—thus producing a crisper sound—.

The weight of a cymbal can also be adjusted to effect sound. In general, increasing weight increases sound volume potential. Decreasing weight has the opposite effect. Likewise, changes in cymbal material composition effect sound production. Most cymbals are comprised of bronze (a copper/tin alloy). Changes in the ratio of copper to tin may be an effective means of altering cymbal sound characteristics. For example, increasing tin content softens the overall alloy and yields a very musical cymbal capable of wide sound spectrum production. As tin content decreases, sound production begins to favor higher frequencies for a lighter, livelier sound. Other metals such as, for example, zinc, aluminum, silver and manganese may also be utilized in cymbal production in order to alter sound.

In addition to cymbal size, shape, weight, construction and material composition, the perception of cymbal sound quality is greatly effected by the environment in which the cymbal is utilized for performance. A given cymbal which produces very acceptable sound within a small recording studio will sound quite different in a large concert hall. Similarly, each concert hall—having its own acoustic characteristics—will likewise change the apparent sound quality and volume of a particular cymbal.

Various sound absorption and sound barrier materials have been utilized in order to adjust and tune the acoustic qualities of a given room or otherwise enclosed space. Sound absorbing material are comprised, for example, of various foam materials such as polyurethane, polyester and polyether foams. In addition, both felt materials comprised of natural fiber and felt comprised of polyurethane, polyester and polyether polymers has also proved quite effective as a sound absorption material. In addition, surfacing both the aforementioned foam and felt sound absorbing materials with a surface treatment or additional surface layers such as, for example, a metal foil, metalized Mylar, perforated vinyl, polyvinylflouride can be utilized to reduce high frequence noise absorption while maintaining and, in some cases, increasing lower frequency absorption. Vibration damping technology, on the other hand, is not usually applied to change the acoustic characteristics of a room or space, but is rather utilized to reduce the resonant vibrations of a source of noise. Vibration damping materials may be simply sheet materials made of any suitable viscoelastic material. Such material, affixed to a resonant sound source, store resonant vibrations (strain) via material deformation and then dissipate the stored energy via, for example, hysterisis or through simple expansion and compression. Constrained layer damping materials place a like visco-elastic material located between and bonded to two relatively hard constraining layers. Such material layers are often glued together but most effectively utilize glues that demonstrate a high shear stiffness.

In the past, percussion musicians, relegated to performing in a given environment with set acoustic properties, have attempted to adjust cymbal sound in accordance with such an environment. For a given performance environment, musicians might choose to experiment with various cymbal types (as discussed above). However, even after selecting the "best" cymbal for a given performance and auditorium, musicians still required fine tuning of the instrument. To accomplish such fine tuning, musicians might, for example, utilize small pieces of adhesive tape, placed at various positions on the cymbal, in order to adust cymbal volume, frequency and sound duration. Adhesive tape was somewhat effective in providing limited damping of cymbal vibration—and thus altering sound production—. However, such tape did not, in itself, demonstrate significant sound absorbency, provide accurate fine tuning or produce easily repeatable results. More specifically, musicians utilizing tape tuning would simply "experiment" with various cymbal locations until they found an optimal position. In addition, after much experimentation in tape or other material placement, no reliable and consistent means was available for re-locating the tape, at a future date, in a like position for optimum sound production at a selected auditorium. It would be most desirable if an effective means of tuning the sound production of a cymbal were provided wherein such means provided both sound absorption as well as vibration damping. It would be further desirable if a method were to be disclosed which allowed for accurate placement and recording of placement of a cymbal tuning means so as to enable consistent and repeatable optimized cymbal tuning for a given performance environment.

SUMMARY OF THE INVENTION

Now in accordance with the present invention, a novel method of optimizing the sound produced by a musical cymbal in a specific performance location is disclosed. In the first preferred embodiment of the present invention, said method comprises positioning a cymbal having an upper surface and a lower surface in a specific performance location where said cymbal is to be utilized.

At least one of the upper and lower surfaces of the cymbal are mapped with markings enabling precise placement of sound absorbing, vibration damping or both sound absorbing and vibration damping segments thereupon (as discussed in greater detail, below. More specifically, at least one of the lower surface and upper surface of the cymbal is marked with specifically identified tuning locations for the precise placement of either sound absorption and/or vibration damping segments of the present invention, or, combinations thereof. In a first preferred embodiment of the method of the present invention, at least one surface of the tuneable cymbal includes markings outlining the specific shapes of the aforementioned segments. These outlines, including, for example, round, square, rectangular, elongated and circumferential outlines, include therewithin, numbers, letters or other indicia representative of the location thereof. Thus, sound absorbing and/or vibration damping segments may be placed within outlines selected in order to provide desired and recordable cymbal tuning for a given performance and performance environment. Once selected outlines are chosen for such placement, the precise location of the segments placed may be easily recorded, utilizing the letter, number or other indicia unique to each outline marking. Thereafter, reference to the recorded placement of the segments enables the cymbal to be repeatedly tuned in that same manner to produce the desired sound output (in a selected performance environment).

In an alternate preferred embodiment of the present invention, the mapped cymbal is marked with a grid forming a multitude of square box outlines for precise segment placement on the upper surface, lower surface or both upper and lower surfaces of the cymbal. Thus, these grid markings, which are substantially similar to the marking format utilized on standard graph paper, advantageously define boxes formed by the grid. Each of these boxes may be marked to include a letter, number or other indicia providing precise and recordable box locations. In practicing the present invention, the indicia of each box covered, or partially covered by a placed segment is recorded for future reference. In addition, and, as described in further detail, below, other means of mapping cymbal surfaces are provided so as to enable precise placement—and recording of placement—of sound absorbing and/or vibration damping segments.

Thereafter, at least one segment of sound absorbing material having a specific, predetermined shape and thickness is affixed to the mapped upper surface, lower surface (or inferior surface) or both upper and lower surfaces of the cymbal. The upper or superior surface of a cymbal is ordinarily the surface struck during performance to elicit sound from the instrument. Therefore the lower surface may provide more convenient placement of the segment(s). Thus, the sound absorbing segment(s) is advantageously affixed to either the lower surface, upper surface or both surfaces of the cymbal. For this purpose, in the method of the present invention, at least one surface of the sound absorbing segments have a non-hardening adhesive applied thereto capable of retaining said segment to a surface. However, certain embodiments of the present invention utilize a sound absorbing material demonstrating sufficient inherent adhesive qualities so as to obviate the need for an additional adhesive. For example, silicon based materials may demonstrate sufficiently high surface adhesion to allow segments formed therefrom to be retained upon a cymbal surface with no need for a separate adhesive element. The segments of the present invention are formed in specific predetermined shapes such as, for example, square, rectangular, round, elongated and ring-like shapes demonstrating specific length, width and depth. The use of specific and predetermined shapes with defined dimensions enable consistent re-creation of the tuning provided by recorded segment placement (as discussed in more detail, below). The ring-like shape segments are formed as a continuous circle which may be placed, circumferentially upon the surface(s) of a cymbal. Such placement may, in part, have the effect of reducing the effective diameter of a cymbal upon which they are placed so as to alter the frequency, volume and duration of cymbal sound in such a manner as to approximate a smaller diameter instrument. The other above-described segment shapes are placed upon the surface(s) of the cymbal in order to change the afore-mentioned sound characteristics thereof. Utilizing specific, pre-determined segment shapes (demonstrating pre-determined dimensions), in combination with recording the positions upon the cymbal where such segments are placed, allows a musician, once he has obtained a desired cymbal sound in a give performance environment, to reliably repeat such "tuning" in the future. However, in regard to each individual performance environment, selected cymbal, and desired sound, repeated placement of one or more segments may be required in order to obtain what the musician determines to be the "optimal" sound produced by the cymbal in consideration of the type of music to be played, and the musician's own preferences. Therefore the term "optimal sound" refers to the sound production the musician deems best in consideration of the aforementioned factors.

Adhesives such as, for example, pressure sensitive, non-hardening acrylic adhesives are advantageously selected for such adhesion as such materials resist vibration detachment yet, at the same time, may be physically removed from the surface of the cymbal without leaving a significant adhesive residue. U.S. Pat. No. 6,902,786 discloses another type of pressure sensitive adhesive which advantageously leaves no residue upon the removal of materials adhered upon a surface thereby when such materials are removed. This material comprised of at least 40% by weight of a hydrogenated random copolymer consisting of 1 to 50% by weight of styrene, and 99 to 50% by weight of a diene hydrocarbon and 10 to 60% by weight of a tackifier resin, a softening agent, or a combination of a tackifier resin and a softening agent also provides the required characteristics of the adhesive required by the present method. However, any pressure sensitive, non-hardening adhesive (non-curing) which provides sufficient retention of the noise absorbing segments to a cymbal may be utilized. Adhesives, including pressure sensitive adhesives, which harden, tend to leave residues upon the cymbal surface upon segment removal and are thus undesirable for use with the present method. Also, such hardening may interfere with the ability of the segments to absorb sound as well as to provide vibration damping (discussed below).

In practicing the method of the first preferred embodiment of the present invention, at least one sound absorbing segment is initially affixed to a selected position located upon a lower or upper surface of the cymbal. In the present method, recording of the specific location of segment(s) placed enhances the ability of the musician to alter segments so as to achieve (tune) variations in cymbal sound production, as well as to provide a record for quickly duplicating such tuning in the future.

After placement of the segment(s), the musician strikes the cymbal in such a manner as to produce sound which he may then evaluate in terms of volume, frequency and duration. The sound absorption qualities of the sound absorption segment(s) as well (as described below) vibration damping qualities provided thereby, alter the volume, frequency and duration of the sound produced by the cymbal so as to enable tuning of the instrument. Since different concert halls, auditoriums, recording studios and other performance environments exhibit unique acoustic qualities, a particular cymbal's sound output will be perceived differentially in different such locations. Therefore, the methods of the present invention enables a musician to "tune" a cymbal so as to provide a specific sound output the musician perceives as optimal for such environments. The methods of the present invention also enable such tuning to be utilized to alter sound production from a particular cymbal to be optimized in regard to a particular type of music or musical composition.

After affixing at least one segment of sound absorption material to the cymbal, a musician plays the cymbals so as to evaluate the sound produced thereby. Thereafter, in accordance with the desirability of the sound produced, the positions of the one or more segments of sound material may be altered, removed (one or several) or additional segments added in order to vary the sound (tune) the instrument until the musician has attained the sound he determines best for the music to be played, sound environment and audience.

The method of the present invention is applicable to all musical cymbals including, but not limited to high hat, crash, ride, splash and china cymbals. The sound absorption material utilized in practicing the present invention may be comprised of any sound absorption material capable of absorbing and/or altering the sound produced by a musical cymbal. However, such materials must be capable of being formed in the above-described discrete shapes. Further, the sound absorption material must also be compatible and retain non-hardening pressure sensitive adhesives such as those described above. It is preferred that the sound absorption materials be formed of a polymer plastic or a felt material. If the sound absorption material is formed of a polymer plastic, it is preferred that such plastics be selected from a polyurethane, polyester, polyether or polyvinyl plastic materials or combinations thereof. It is further preferred that such plastic materials be foam material of either the open or closed cell configuration. In addition, thermoplastic materials such as natural rubbers and synthetic rubber materials such as, for example, nitrile rubbers may also be utilized as sound absorption material. The sound absorbing material may also comprise silicon compounds which may also, as discussed below, provide inherent adhesive qualities. Both natural and synthetic rubbers may be advantageously formed as both open and closed cell materials to provide a wider range of sound absorption qualities.

As mentioned above, felt materials may be advantageously utilized to form the selected sound absorption segment utilized in the first preferred method of the present invention. In such instances, the felt material may be formed of, for example, a natural fiber such as wool, synthetic fibers such as polyester, rayon or nylon. In addition, felts fabricated of natural/synthetic material such as, for example, rayon/wool, polyester/wool or nylon/wool may be utilized to form a felt sound absorption material utilized in the method of the present invention.

All of the aforementioned sound absorption materials will, in addition to providing cymbal sound absorption, provide, to a degree, reduction of cymbal vibration. Thus, all of the aforementioned materials also may also some provide vibration damping. However, in the method of the second preferred embodiment of the present invention, vibration damping is the primary purpose of attaching the below-described sound-damping material to a cymbal.

In the second preferred embodiment of the present invention, a method of optimizing the sound produced by a musical cymbal in a specific performance location is disclosed wherein a cymbal having, an upper surface and a lower surface is positioned within a specific performance location wherein the cymbal is to be played. As discussed above, in regard to the first preferred embodiment, in the second preferred method of the present invention, at least one of the upper and lower surface of the cymbal are marked "mapped" for precise and recordable location of segments.

In the method of the second preferred embodiment, at least one segment of vibration damping material (vibration damping segment) having a specific, predetermined shape and thickness is attached to a mapped lower, upper or both upper and lower surfaces of the cymbal.

As utilized in this specification and throughout the claims, the term "upper surface" in regard to cymbals refers to that flat and substantially round and planar surface (but often with some degree of slope) usually oriented upward and located at the top of a cymbal when the instrument is mounted on a stand and ready to play. This is the same surface ordinarily struck with a drum stick when the instrument is played. The term "lower surface" in regard to cymbals, as utilized throughout this specification and within the claims refers to the substantially round and planar surface of the instrument ordinarily oriented and facing downward when the instrument is mounted on a stand and ready for play. Most cymbals include a thin circumferential radially edge located along the outside perimeter of what may be described as a disc-like instrument. However, certain cymbal types, most notably "high hat" cymbals, include a circumferential elongated edge extending downward from the cymbal, perpendicular to the long axis of the instrument.

The at least one vibration damping segment includes a surface having a non-hardening adhesive applied thereto capable of retaining the segment to the mapped lower, upper or both upper and lower surfaces of a cymbal during both "tuning" and playing thereof as described above in regard to the first preferred method. After affixing the at least one segment of sound damping material to a selected position located upon the lower surface of the cymbal, the position of the segment(s) upon the cymbal's lower surface is recorded. Thereafter, the cymbal is played and the sound produced thereby is evaluated by a musician who is expert in such percussion instruments and, ordinarily, is the same musician who will perform with the cymbal.

The vibration damping qualities of the sound damping segment(s) as well (as described below) sound absorption qualities provided thereby, alter the volume, frequency and duration of the sound produced by the cymbal so as to enable tuning of the instrument. Since different concert halls, auditoriums, recording studios and other performance environments exhibit unique acoustic qualities, a particular cymbals sound output will be perceived differentially in different such locations. Therefore, the methods of the present invention enables a musician to "tune" a cymbal so as to provide a specific sound output the musician perceives as optimal for such environments. The methods of the present invention also enable such tuning to be utilized to alter sound production from a particular cymbal to be optimized in regard to a particular type of music or musical composition.

In practicing all of the methods of the present invention, the one or more segments of sound absorbing material or vibration damping material may be affixed to the surface of the cymbal at different points, in different amounts as well as different shapes. Each time a "new trial" of segments is applied to the cymbal, the positions of said segments are recorded so as enable reproduction of a given configuration once an optimum configuration—a configuration of one or more such segments affixed to a cymbal providing what the musician perceives as optimal sound—is produced. As discussed above, the term "optimal sound production" means that quality of cymbal sound production comprised of volume, frequency range and duration a musician deems best in regard to the sound he or she desires in a particular performance environment for a particular type of music or musical composition. Thus, for example, a musician may desire, for a rock performance in a large hall, a very bright sound with higher frequency production and minimal duration for a bright, sharp sound. In other instances, he or she may require a broader frequency range and longer duration for performance during a classic symphony. In each case the cymbal is tuned to provide the desired sound characteristics by application of sound absorption segments, vibration damping segments or, as discussed below, in combination thereof. As in regard to the first preferred method of the present invention, the disclosed methods are applicable to musical cymbals of all types including, but not limited to high hat, crash, ride, splash and china cymbals.

The vibration damping material of the present invention is configured into vibration damping segments having various predetermined shapes in order to provide alternative tuning choices and effects. Thus, like the first preferred method, vibration damping segments may be configured, for example, as square, rectangular, elliptical and circular segments. Providing various segment shapes enables fine tuning of sound. At the same time, the methods of the present invention utilize definite and determined segment shapes of specific and identified dimensions and of identified composition, in combination with a mapped cymbal in order to enable consistent re-creation of tuning In addition to the above-mentioned shapes, ring-shaped vibration segments, especially useful for circumferential placement upon the lower, upper or both lower and upper surfaces of a cymbal may be utilized to, in part, effectively reduce the vibration producing diameter of the instrument.

The vibration damping material may be selected to be comprised of a viscoelastic material wherein hysterisis provides the energy absorbing (and thus damping qualities to the segment, or a composite material wherein a combination of shearing forces created between pliable elastomeric and rigid material is largely responsible for energy absorption and the resulting damping effect.

Viscoelastic materials may be selected to be, for example, plastic polymers. Most advantageously, polyurethane viscoelastic materials may be utilized. However, viscoelastic materials comprised of polyester, polyvinyl and polyether materials may also be utilized. Composite materials comprised of, for example, an elastomeric polymer bonded to a rigid fully cured non-elastomeric polymer or an elastomeric polymer material bonded to a metal material. In embodiments wherein metal containing composites are utilized, the metal may be a solid sheet metal, metal foil or metalized polymer such as, for example, metalized Mylar (polyester). Any suitable metal such as, for example, aluminum, tin, copper, silver or gold may be utilized in forming the composite.

The polymer may be selected from plastic polymers such as, for example, polyurethane, polyester and polyether plastic polymers. In addition, the elastomeric polymers may be selected to be foam materials of either open or closed cell design. Composite damping material wherein natural or synthetic rubber such, as for example, nitrile rubber, may be utilized for the elastomer component. Likewise, such rubber materials may also be selected to be foam rubber materials.

Regardless of material type, composite damping material utilized in practicing the second preferred method of the present invention permanently bonds elastomeric materials to a rigid non-elastomeric material (such as a metal, metalized material or fully cured non-elastomeric polymer). Vibration damping is provided by transforming vibrations emanating from the cymbal to the rigid/elastomeric interface where shearing forces develop and dissipate the energy. However, to a certain degree, distortion and return of the elastomer content of the composite also accounts for some degree of energy absorption. Like the method of the first preferred embodiment, segments of damping material may not produce a pure vibration damping effect. Beyond vibration damping, such materials may also provide a certain degree of sound absorption.

The present invention also discloses sound absorption material and vibration damping material especially configured and adapted for use in controlling and thus tuning the sound of cymbals to which they are affixed. Both the sound absorbing and sound damping segments of the present invention are formed in specific shapes including square, rectangular, elongated circular and ring-like configurations. Both the sound absorbing and sound damping segments of the present invention include, on one surface, a pressure sensitive, non-hardening adhesive providing the segments with sufficient retentive characteristics so as to hold them, securely, to the upper, lower or, both upper and lower surfaces of a cymbal during use.

Adhesives such as, for example, pressure sensitive, non-hardening acrylic adhesives discussed above in regard to the first preferred embodiment, are advantageously selected for such adhesion as such materials resist vibration detachment yet, at the same time, may be physically removed from the surface of the cymbal without leaving a significant adhesive residue. However, any pressure sensitive, non-hardening adhesive (non-curing) which provides sufficient retention of the noise absorbing segments to a cymbal may be utilized.

It is also preferred that both the sound absorbing and vibration damping materials of the present invention be provided in mats wherein a multiple number of such segments, in multiple shapes and sizes be provided on a plastic sheet such as, for example, a Mylar sheet from which said segments may be easily removed prior to use. Mylar® is an extraordinarily strong polyester film that grew out of the development of Dacron® in the early 1950s and provides a convenient material for organizing and holding the segments of the present invention prior to use thereof.

It is preferred that the vibration absorption segment of the present invention be formed of a plastic polymer plastic such as, for example, a polyurethane, polyester, polyether or polyvinyl plastic. It is also preferred that it be formed of a natural or synthetic rubber (such as, for example, nitrile rubber) or a felt material. If the sound absorption material is formed of a polymer plastic or rubber material, such materials may be formed as foam materials. If felt materials are utilized, they may be advantageously selected to be formed of, for example, a natural fiber such as wool, synthetic fibers such as polyester, rayon or nylon. In addition, felts fabricated of natural/synthetic material such as, for example, rayon/wool, polyester/wool or nylon/wool may be utilized to form felt sound absorbing segments.

The vibration damping segments of the present invention may be selected to be comprised of a viscoelastic material wherein hysterisis provides the energy absorbing (and thus damping qualities to the segment), or a composite material wherein a combination of shearing forces created between pliable elastomeric and rigid material is largely responsible for energy absorption and the resulting damping effect. These viscoelastic materials may be selected to be, for example, plastic polymers. Most advantageously, polyurethane viscoelastic materials may be utilized. However, viscoelastic materials comprised of polyester, polyvinyl and polyether materials may also be utilized. Composite materials comprised of, for example, an elastomeric polymer bonded to a rigid fully cured non-elastomeric polymer or an elastomeric polymer material bonded to a metal material may be selected as vibration damping materials. In embodiments wherein metal containing composites are utilized for vibration damping segments of the present invention, the metal may be a solid sheet metal, metal foil or metalized polymer such as, for example, metalized Mylar (polyester). Any suitable metal such as, for example, aluminum, tin, copper, silver or gold may be utilized in forming the composite.

The polymer used for such vibration damping segments may be selected from plastic polymers such as, for example, polyurethane, polyester and polyether plastic polymers. In addition, the elastomeric polymers may be selected to be foam materials of either open or closed cell design. Composite damping material wherein natural or synthetic rubber such, as for example, nitrile rubber, may be utilized for the elastomer component. Likewise, such rubber materials may also be selected to be foam rubber materials.

Regardless of material type, the composite damping material utilized in fabricating the vibration damping segment of the present invention is configured so as to permanently bond an elastomeric material to a rigid non-elastomeric material (such as a metal, metalized material or fully cured non-elastomeric polymer). Vibration damping is provided by transforming vibrations emanating from the cymbal to the rigid/elastomeric interface where shearing forces develop and dissipate the energy within the segment. However, to a certain degree, distortion and return of the elastomer content of the composite may also account for some degree of energy absorption. Like the sounding absorbing segments of the present invention the sound damping segments disclosed herein do not produce a purely damping effect. Beyond vibration damping, such segments also provide a certain degree of sound absorption.

The present invention also discloses a mapped cymbal especially configured and adapted for accurate and precise placement of sound absorption and vibration damping segments thereupon. Thus, the mapped cymbal of the present invention provides a highly tuneable cymbal enabling the recording of segment placement configuration providing desired cymbal sound in order to enable fine tuning of cymbal sound as well as rapid repeat reproduction of said placement for future performances.

More specifically, the mapped and tuneable cymbal of the present invention includes an upper surface, a lower surface and a circumferential edge. At least one of the lower surface and upper surface of the cymbal is marked with specifically identified tuning locations for the precise placement of either sound absorption and/or vibration damping segments of the present invention, or, combinations thereof. In a first preferred embodiment of the mapped cymbal of the present invention, at least one surface of the tuneable cymbal includes markings outlining the specific shapes of the aforementioned segments. These outlines, including, for example, round, square, rectangular, elongated and circumferential outlines, include therewithin, numbers, letters or other indicia representative of the location thereof. Thus, sound absorbing and/or vibration damping segments may be placed within outlines selected in order to provide desired cymbal tuning for a given performance and performance environment. Once selected outlines are chosen for such placement, the precise location of the segments placed may be easily recorded, utilizing the letter, number or other indicia unique to each outline marking. Thereafter, reference to the recorded placement of the segments enables the cymbal to be repeatedly tuned in that same manner to produce the desired sound output (in a selected performance environment).

In an alternate preferred embodiment of the present invention, a mapped cymbal is disclosed which is marked with a grid forming a multitude of substantially square box outlines for precise segment placement. Thus, these grid markings, which are similar to the marking format utilized on standard graph paper, advantageously define boxes formed by the grid. Each of these boxes may be marked to include a letter, number or other indicia providing precise and recordable box locations. In practicing the present invention, the indicia of each box covered, or partially covered by a placed segment is recorded for future reference.

Alternatively, two diametric line markings of the grid, spanning the full diameter of the cymbal, and being disposed at 90 degrees to one another, are marked as the absissa (X) and ordinate (Y) line. Starting from the diametric center of the cymbal, each such line is marked, at its intersection with perpendicular intersecting lines, with positive and negative numbers in the same manner as the "X" and "Y" axis are marked in a Cartesian coordinate system. In the Cartesian coordinate system, two perpendicular real axes in a plane define a (rectangular planar) Cartesian coordinate system. In the alternative preferred embodiment of the present invention, either the lower, upper or both planar surfaces of a cymbal are marked with a similar Cartesian coordinate grid. The common origin of the "X" and "Y" axis marked on the upper or lower (or both) surfaces of the cymbal occur at the diametric center of the device where the cymbal is ordinarily attached to a stand. In the alternate preferred embodiment of the present invention, one of the two complete diametric axis is marked as horizontal with, for example and "X" and the other marked as vertical (with, for example, a "Y"). The positive directions, as in the Cartesian systems, are to the right and upwards. Since a cymbal is a bilaterally symmetric device, the "X" and "Y" axis are selected arbitrarily. However, it may be advantageous to position the cymbal, during tuning, so that the positive terminus of the "X" and "Y" axis are oriented in definite directions in regard to the surrounding environment (as discussed below). In this manner, segment placement can be recorded, not only as to position upon the cymbal, but in regard to the orientation of the cymbal to the surrounding performance environment. For example, the cymbal may be oriented so that the positive terminus of the "Y" axis is directed forward, towards stage center. Then it would follow that the positive terminus of the "X" axis would be oriented towards stage right (if the upper surface of the cymbal is mapped and being examined). If the lower surface of the cymbal is mapped and being examined, the positive terminus of the "X' axis, during cymbal use, would be directed towards stage left.

After desired locations are found for sound absorbing and/or vibration damping segments, the precise locations of the segments may be recorded utilizing the "X" and "Y" coordinates of the segment(s) location (including the type (composition), dimensions and shape of the segment) or by recording the indicia markings (e.g. letter/numbers) of the boxes covered by the segment(s). In addition, and, as discussed above, a record of cymbal tuning made in accordance with the method and devices of the present invention may also indicate the orientation of the cymbal in relation to the performance environment by recording the relative positions of the positive terminus of the "X" axis, "Y" axis or both. In most instances, it is believed that orienting the positive terminus of the "Y" axis towards stage front will provide consistent recording practices.

In practicing the alternate preferred embodiment of the present invention, the location of ring-like segments place upon a mapped surface of the cymbal may be simply and accurately recorded by centric placement of these segments (in relation to the diametric center of the upper or lower surface of a cymbal, and recording the intersection point of the segment with either the "X" axis, "Y" axis or both. However, since the ring-like segments are formed with definitive diameters which may, of course, also be recorded, recording of such diameters should be sufficient in when centric placement is utilized. The aforementioned first and second preferred mapped cymbals are two examples of the mapping disclosed in the present invention. The present invention contemplates all systems of marking the upper, lower or both upper and lower surfaces of a cymbal in order to provide precise location, and the recording of placement of sound absorbing and vibration damping segments. It is also contemplated that the mapped cymbal of the present invention may be advantageously utilized with, in addition to the segments disclosed herein, other materials and or devices placed upon the upper or lower (or both) surfaces of a cymbal in order to provide precise recording of the location thereof.

The upper, lower or both upper and lower surfaces of the cymbal may be mapped utilizing inks, acid etching, abrasive technologies, mechanical scoring and/or laser marking as well as any other technique that provides discernible mapping. Techniques of marking metals such as those discussed above in regard to cymbal composition are well known to the art and will not be discussed further here. However, it is highly advantageous to utilize, whatever method is selected, the most conservative techniques so as to avoid any significant removal of metal or addition of marking materials (weight) so as to avoid altering the sound output of the instrument. The term "mapped" as utilized throughout this description and in the claims refers to a cymbal which includes markings, as described above and below, located upon its upper, lower or both upper and lower surfaces which enables the recording of the location of sound absorbing and/or vibration damping segments placed thereupon.

The present invention thus provides, for the first time, a method of precisely placing—and recording the placement of—sound absorbing and/or vibration damping segments wherein precise segment shape, dimensions and identified composition, in combination with mapped cymbals allows consistent and rapid recreation of desired cymbal tuning.

The tuneable cymbal of the present invention may be of any of the useful types and configurations such as, for example, a high hat, crash, ride, splash and china cymbal. Furthermore, it may be advantageously formed of any suitable material such as, for example, bronze (copper/tin alloys), copper/zinc, copper/aluminum and copper/manganese alloys. However, the tuneable cymbal of the present invention includes clearly marked and discrete position locations on the lower surface thereof. Such markings, utilizing either numeric, letter, alpha/numeric or other identifying indexes allow the consistent application of the aforementioned segments to various positions along the radius and circumference of the lower, upper or both lower and upper surfaces.

As more specifically described below, the tuneable cymbal of the present invention enables precise and repeatable tuning of cymbals by mapping the lower surface of the instrument. The mapping not only allows a musician to record an optimal tuning configuration (consisting of the location, number and shape of segments affixed to a cymbal producing a desired sound), but also allows quicker adjustment of sound output by providing landmarks by which a musician can determine whether, for example, to move segments outward (towards the circumferential edge of the instrument) inward (towards the radial axis thereof, or towards (or away) from any direction such as, for example, stage right, center stage or stage left. Also, since, as described above, each performance environment and musical composition/music type may demand different cymbal tuning, recording of segment configuration for a particular location and music enable fast and simply re-tuning of cymbals for return performances at a given location.

BRIEF DESCRIPTION OF THE DRAWINGS

FIG. 4 is an upper view of a preferred embodiment of a tuneable cymbal of the present invention.

DETAILED DESCRIPTION

Figure 1:
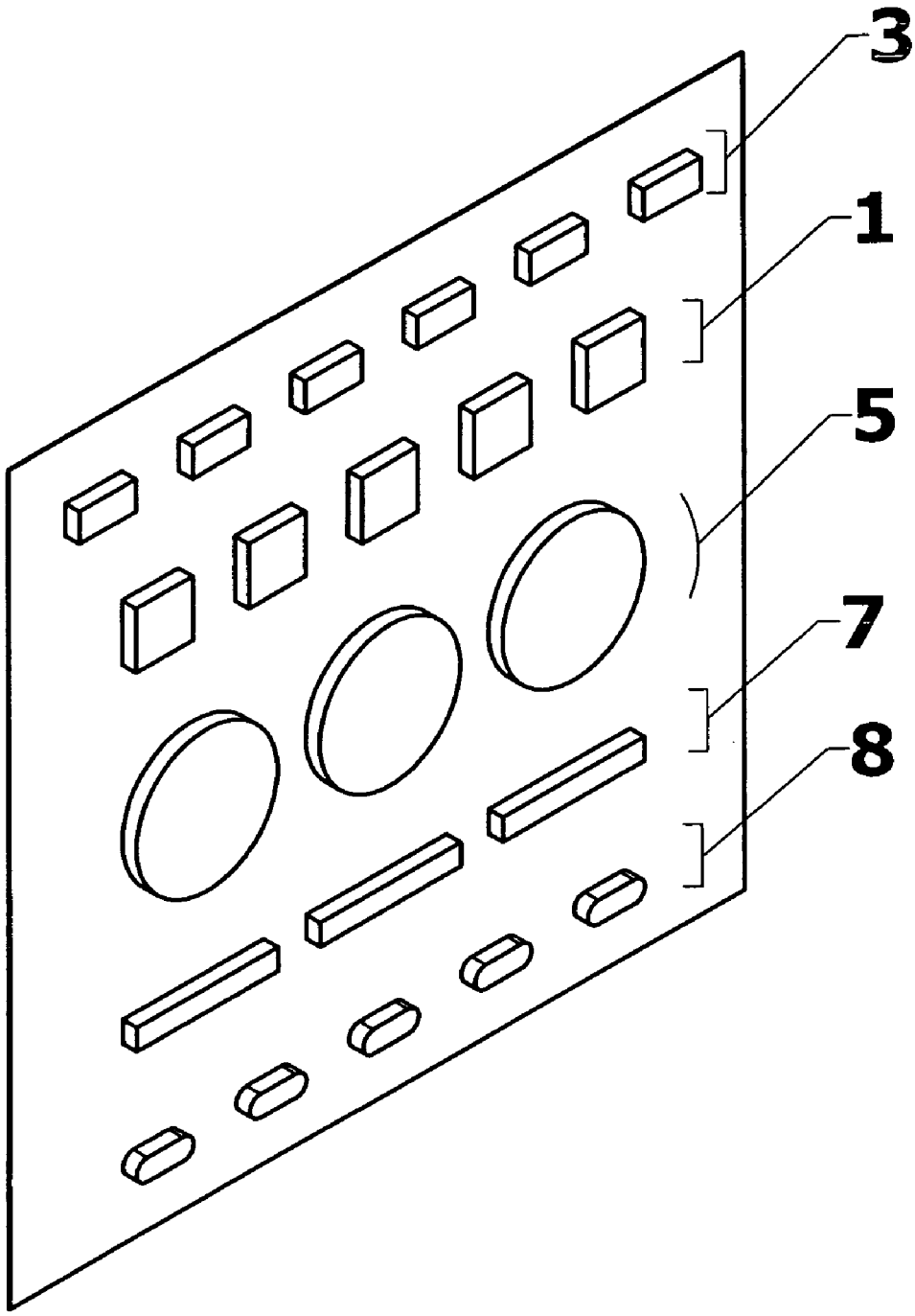
FIG. 1 illustrates a mat of segments utilized in practicing the present invention

As discussed above, the sound absorbing and vibration damping segments of the present invention are configured and formed to demonstrate specific shapes and dimensions which, in the preferred embodiment of the present invention, provide standardized segments. In addition, standardized segments are provided in the various sound absorbing and vibration damping materials and configurations (e.g. composites) discussed above.

More specifically, the preferred embodiment of the present invention provides standardized segments demonstrating square, rectangular, circular and elongated shapes. In addition, ring-shaped segments are provided. Each of the aforementioned standardized segments is advantageously provided in standardized dimensions reflecting, in regard to circular segments, the diameter and thickness thereof, in regard to square, rectangular and elongated segments, the height, width and depth thereof, and in regard to ring-like segments, the diameter, width and depth thereof. Each standardized segment may be, for example, identified by a simple number and shape indicating the aforementioned configuration and dimensional attributes. The following table indicates examples of standardized segments. However, the present invention is not limited to these specific dimensions. These standardized segments are examples of the utility provided by utilizing standardized dimensions for obtaining repeatable results (described below). Segments demonstrating greater or lesser dimensions may also be utilized.

| | Square (H/W/D) in mm. | Rectangular (H/W/D) in mm. | Circular (Diameter/ Depth) | Elongated (H/W/D) |
|---|---|---|---|---|
| No. 1 | 10 × 10 × 5 | 10 × 5 × 5 | 15 × 5 | 10 × 5 × 5 |
| No. 2 | 15 × 15 × 5 | 15 × 5 × 5 | 20 × 5 | 15 × 5 × 5 |
| No. 3 | 20 × 20 × 5 | 20 × 10 × 5 | 25 × 5 | 20 × 10 × 5 |
| No. 4 | 25 × 25 × 5 | 25 × 10 × 5 | 30 × 5 | 25 × 10 × 5 |

(The term "H/W/D" refers to the height, width and depth dimensions of the standardized segments. All dimensions provided in millimeters.)

It is preferred that the ring-like segments of the present invention are configured to demonstrate widths of from about 3 to about 10 mm and a thickness of from about 1 mm to about 4 mm. The diameter of the ring like segments are selected to be sufficient to allow centric placement thereof anywhere within the outside diameter of the cymbal upon which they are to be placed.

As discussed above, the present invention provides sound absorbing and vibration damping segments fabricated of all the afore-mentioned materials and configurations such as, for example, composite configurations for vibration damping segments. In practicing the present invention, a musician records the identity of the standardized segments, the number of segments utilized, and the material and configuration thereof (e.g. composite/vibration damping vinyl/metal) as well as the material and configuration thereof when he or she has achieved what they consider optimal sound for a performance environment. The musician also records the position (discussed in more detail above and below) where each said segment is placed upon the upper, lower or both upper and lower surfaces of the cymbal. The act of recording these parameters, in combination with the use of standardized segments of identified material and construction enables consistent reproduction of optimal sound each time the cymbal is tuned for a given auditorium. Thus, a musician initially tunes his instrument via the placement of standardized segments, records the aforementioned parameters, and may thereafter quickly and easily achieve the same tuning at future performances at a given performance environment.

FIG. 1 illustrates a Mylar mat upon which an assortment of segments of the present invention are retained. The Mylar polyester sheet surface allows easy removal of the segments, which, as described above, utilize a non-hardening, pressure sensitive adhesive for retention on a cymbal (as well as the illustrated Mylar sheet. Square 1, rectangular 3, circular 5, elongated 7 and ovoid 8 segments are grouped on the sheet 9 so as to provide convenient use thereof.

Figure 2:
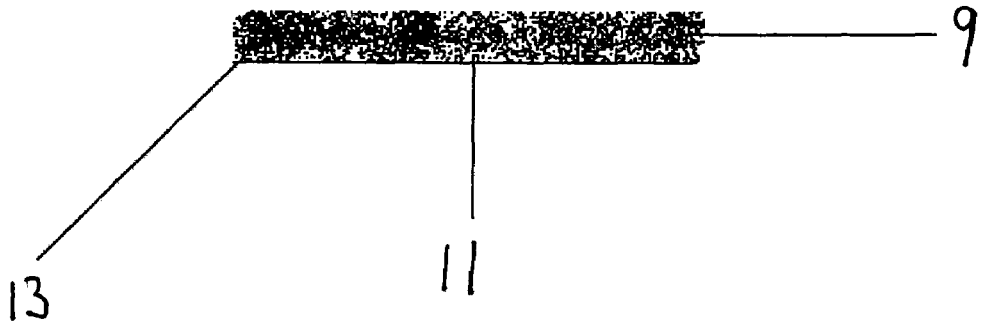
FIG. 2 illustrates a foam sound absorbing segment in accordance with the present invention.

FIG. 2 illustrates a sound absorbing segment in accordance with the present invention. The absorbing material 9 may be, as illustrated in this figure, of a foam type utilizing open or closed cells which provide air spaces 11 for enhanced sound absorption. As discussed above, it is preferred that the sound absorption materials be formed of a polymer plastic or a felt material. If the sound absorption material is formed of a polymer plastic, it is preferred that such plastics be selected from a polyurethane, polyester, polyether or polyvinyl plastic materials or combinations thereof. It is further preferred that such plastic materials be foam material of either the open or closed cell configuration. In addition, thermoplastic materials such as natural rubbers and synthetic rubber materials such as, for example, nitrile rubbers may also be utilized as sound absorption material. Both natural and synthetic rubbers may be advantageously formed as both open and closed cell materials to provide a wider range of sound absorption qualities. A non-hardening, pressure sensitive adhesive 13—as discussed in great detail, above—is applied to one surface of the segment so as to provide proper retention of the segment to a cymbal while, at the same time, enabling removal thereof within leaving appreciable residue on the instrument.

Figure 3:
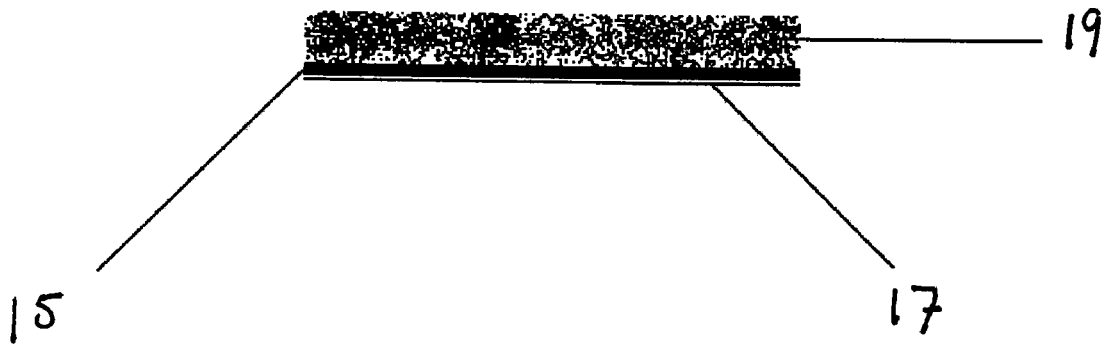
FIG. 3 illustrates a composite vibration damping segment in accordance with the present invention.

FIG. 3 illustrates a vibration damping segment in accordance with the present invention. As discussed above, the vibration damping material may be selected to be comprised of a viscoelastic material wherein hysterisis provides the energy absorbing (and thus damping qualities to the segment, or a composite material wherein a combination of shearing forces created between pliable elastomeric and rigid material is largely responsible for energy absorption and the resulting damping effect. FIG. 3 illustrates a vibration damping segment utilizing a composite configuration. A rigid, non-elastic segment 15 upon which a non-hardening, pressure sensitive adhesive 17 is applied, interfaces with a highly elastic material 19. Vibration, passing from a cymbal to which the segment is applied, causes the non-elastic segment 15 to vibrate. Shearing forces develop at the interface between the non-elastic segment 15 and the elastic material 19. The shearing forces partially dissipate the vibration to achieve damping. In addition, distortion of the elastic portion provides both additional damping as well as some sound absorption effects.

In practicing the preferred embodiment of the present invention, the viscoelastic materials may be selected to be, for example, plastic polymers. Most advantageously, polyurethane viscoelastic materials may be utilized. However, viscoelastic materials comprised of polyester, polyvinyl and polyether materials may also be utilized. Composite segments, such as the one illustrated in FIG. 3, are advantageously comprised of, for example, an elastomeric polymer bonded to a rigid fully cured non-elastomeric polymer or an elastomeric polymer material bonded to a metal material. In embodiments wherein metal containing composites are utilized, the metal may be a solid sheet metal, metal foil or metalized polymer such as, for example, metalized Mylar (polyester). Any suitable metal such as, for example, aluminum, tin, copper, silver or gold may be utilized in forming the composite.

The polymer may be selected from plastic polymers such as, for example, polyurethane, polyester and polyether plastic polymers. In addition, the elastomeric polymers may be selected to be foam materials of either open or closed cell design. Composite damping material wherein natural or synthetic rubber such, as for example, nitrile rubber, may be utilized for the elastomer component. Likewise, such rubber materials may also be selected to be foam rubber materials.

Figure 4:
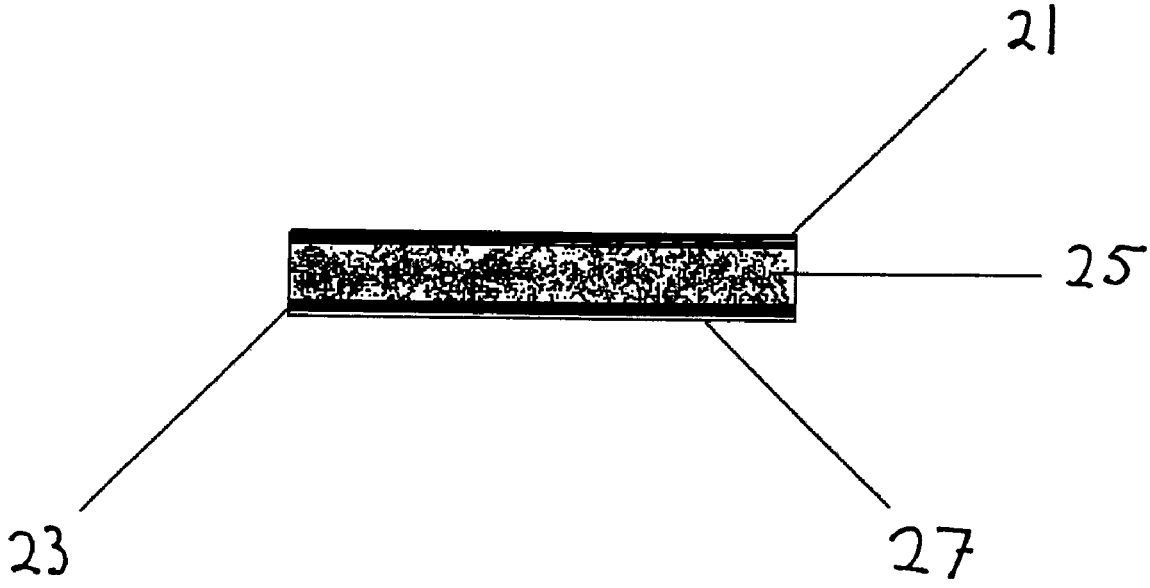
FIG. 4 illustrates a further composite vibration damping segment in accordance with the present invention.

FIG. 4 also illustrates a composite type damping segment. However, the embodiment illustrated in FIG. 4 utilizes two rigid (non-elastic) layers (21 and 23) sandwiching an elastic layer 25 therebetween. Thus, shearing forces can dissipate vibratory force (provide damping) at two, rather than one interface. The elastic layer, as discussed above, provides additional damping as well as some sound absorption functions. A layer of non-hardening pressure sensitive adhesive 27 is applied to rigid layer 23 for segment retention.

As discussed above, the present invention also discloses a mapped cymbal especially configured and adapted for accurate and precise placement—and replacement—of sound absorption and vibration damping segments thereupon. More specifically, the mapped and tuneable cymbal of the present invention includes an upper surface, a lower surface and a circumferential edge. At least one of the lower surface and upper surface of the cymbal is marked with specifically identified tuning locations enabling the precise placement of either sound absorption or vibration damping segments of the present invention, (or, combinations thereof.)

In a first preferred embodiment of the mapped cymbal of the present invention, at least one surface of the tuneable cymbal includes markings outlining the aforementioned segment shapes. However, additional predetermined shapes may be included in said mapping if corresponding segment shapes are configured and utilized. The mapping outlines, including round, square, rectangular elongated and circumferential outlines, include therewithin, numbers, letters or other indicia representative of the location thereof. Thus, sound absorbing and/or vibration damping segments may be placed within outlines selected in order to provide desired cymbal tuning for a given performance and performance environment. Once selected outlines are chosen for such placement, the precise location of the segments placed are be easily recorded, utilizing the letter, number or other indicia unique to each outline marking. Thereafter, reference to the recorded placement of the segments enables the cymbal to be repeatedly tuned in that same manner to produce the desired sound output.

Figure 5:
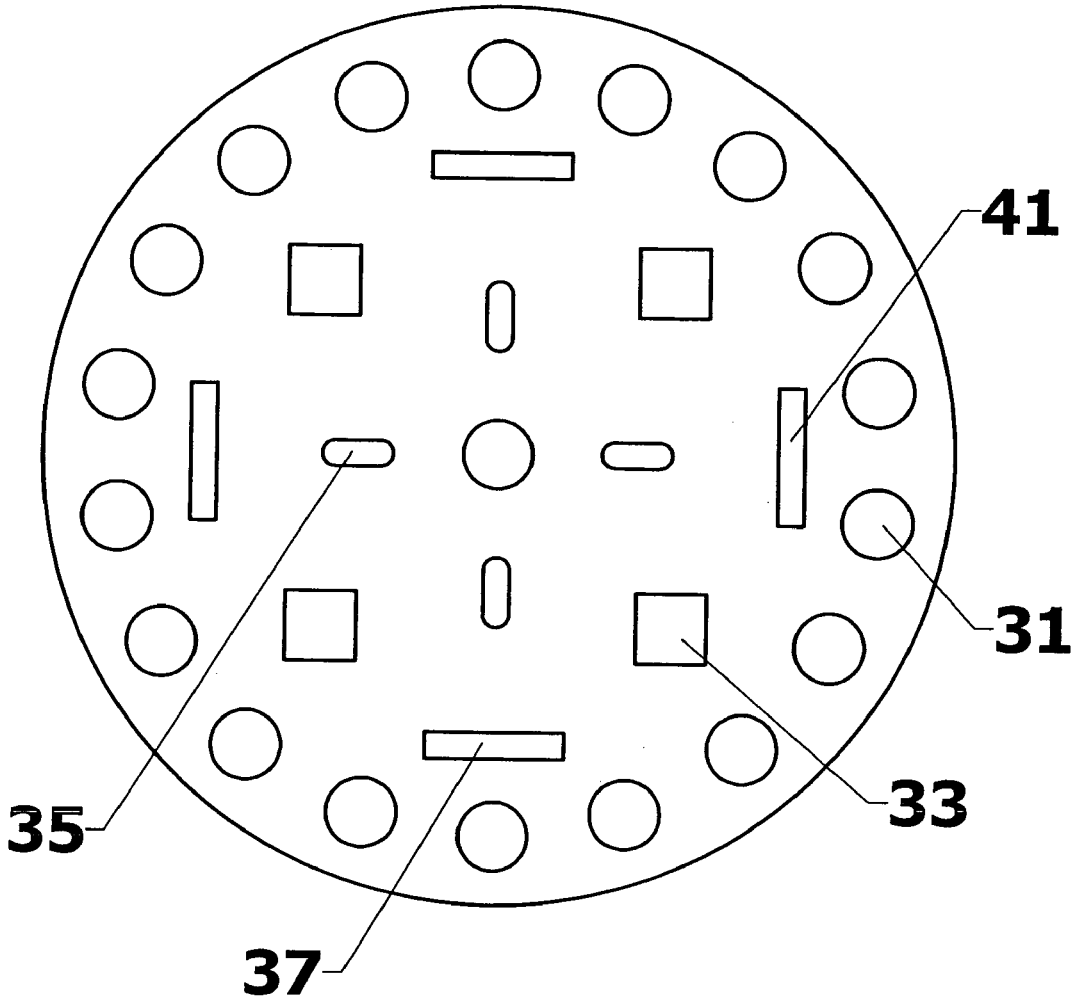
FIG. 5 is a lower view of a preferred embodiment of a mapped cymbal of the present invention.

FIG. 5 illustrates a first preferred tuneable cymbal of the present invention. The first preferred tuneable cymbal of the present invention enables precise and repeatable tuning of cymbals by mapping the lower and/or upper surface of the instrument. The mapping not only allows a musician to record an optimal tuning configuration (consisting of the location, number and shape of segments affixed to a cymbal producing a desired sound), but also allows quicker adjustment of sound output by providing landmarks by which a musician can determine whether, for example, to move segments outward (towards the circumferential edge of the instrument) inward (towards the radial axis thereof, or towards (or away) from any direction such as, for example, stage right, center stage or stage left. The tuneable cymbal illustrated in FIG. 5 includes marked positions for circular 31, square 33, ovoid 35, rectangular 37 and elongated 41 segments.

Figure 6:
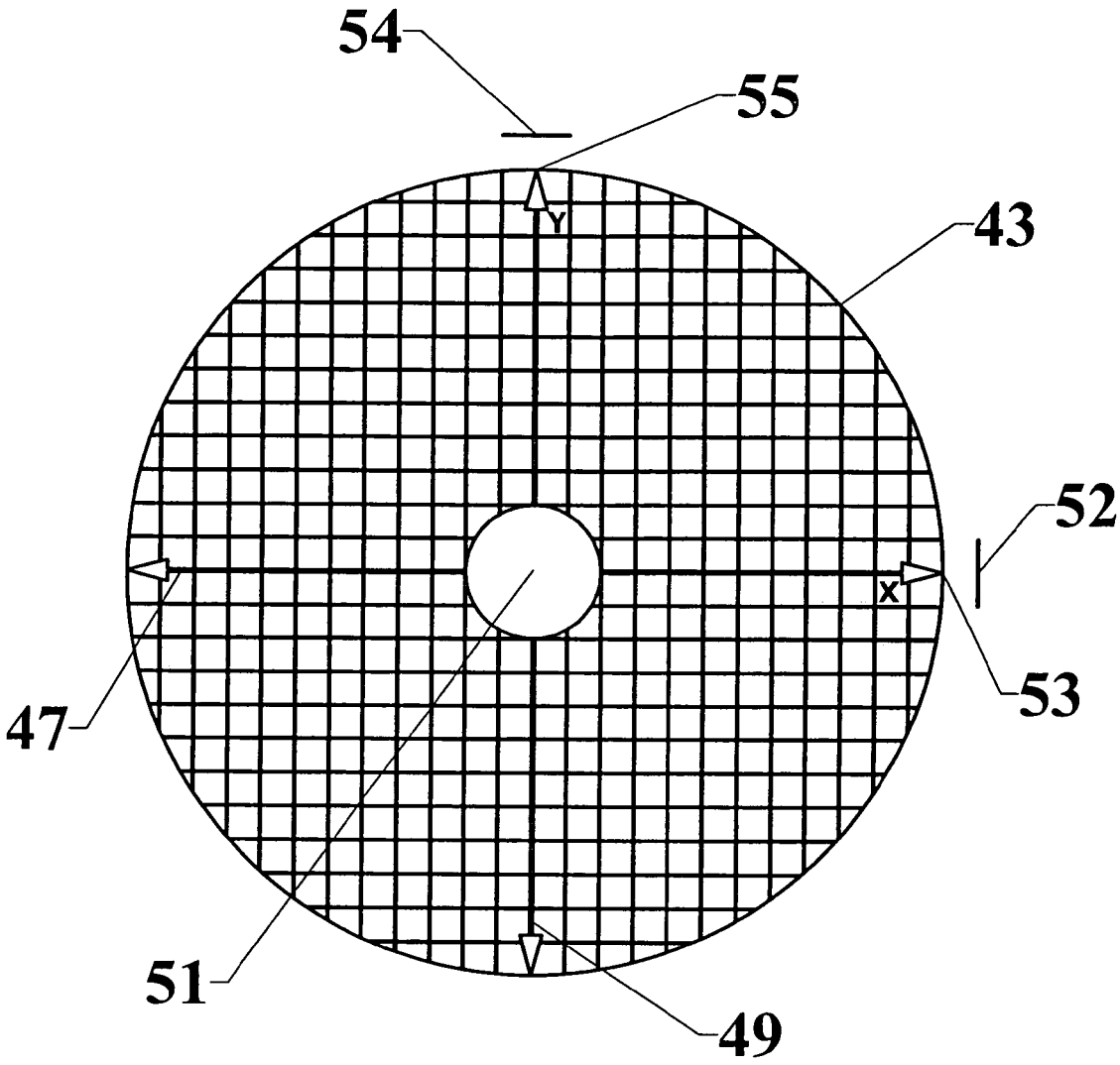
FIG. 6 illustrates a lower surface view of an alternate preferred embodiment of a mapped cymbal of the present invention.

In an alternate preferred embodiment of the present invention illustrated in FIG. 6, a mapped cymbal 43 is disclosed which is marked with a grid forming a multitude of square box 45 outlines for precise segment placement. The grid markings are substantially similar to the marking format utilized on graph paper. Each of these boxes may be marked to include a letter, number or other indicia providing precise and recordable box locations. Alternatively, two diametric line markings of the grid, spanning the full diameter of the cymbal, and being disposed at 90 degrees to one another may be marked as the absissa (X) 47 and ordinate (Y) line 49. Starting from the diametric center of the cymbal 51, each such line may be marked, at its intersection with perpendicular intersecting lines, with positive and negative numbers in the same manner as the "X" and "Y" axis are marked in a Cartesian coordinate system. More specifically, in the Cartesian coordinate system, two perpendicular real axes in a plane define a (rectangular planar) Cartesian coordinate system. In the second preferred embodiment of the present invention, either the lower, upper or both planar surfaces of a cymbal are marked in a similar manner. In this system, the a common point is taken to be the origin of both of these perpendicular axis and the two unit lengths are commonly equal. In the alternate preferred embodiment of the present invention, the common origin of the "X" and "Y" axis marked on the upper or lower (or both) surfaces of the cymbal lie at the diametric center 51 of the device where the cymbal is ordinarily attached to a stand.

In the alternate preferred embodiment of the present invention, one of the two axes is marked as horizontal with, for example an "X" 47 and the other marked as vertical (with, for example, a "Y") 49. The positive directions (which include ascending positive integers) are towards the right of the cymbal 52 and upwards 54. Since a cymbal is a bilaterally symmetric device and may be rotated, the "X" and "Y" axis are selected arbitrarily. However, it is highly advantageous to position the cymbal, during tuning, so that the positive terminus of the axis marked "X" 53 and "Y" 55, marked as such, are oriented in a particular way in regard to the surrounding performance environment. In this manner, segment placement can be recorded, not only as to position relative to the cymbal's planar surfaces, but in regard to the orientation of the cymbal to the performance environment. For example, the cymbal may be oriented so that the positive terminus 55 of the "Y" axis is directed forward, towards stage center. If a lower mapped planar surface of the cymbal is examined, then it would follow that the positive terminus 53 of the "X" axis would be oriented towards stage left. Alternatively, if an upper mapped planar surface of the cymbal is being examine, then the positive terminus 53 of the "X" axis would be oriented towards stage right. After desired locations are found for sound absorbing and/or vibration damping segments, the precise locations of the segments (including composition, dimensions and shape) may be recorded utilizing the "X" and "Y" coordinates of the segment(s) location (including the type and size of segment) or by recording the indicia markings (e.g. letter/numbers) of the boxes covered by the segment(s). In addition, the record of cymbal tuning also indicates the orientation of the cymbal in relation to the performance environment by recording the relative positions of the positive terminus of the "X" axis, "Y" axis or both. In most instances, it is believed that orienting the positive terminus of the "Y" axis towards stage front will provide consistent recording practices.

In practicing the alternate preferred embodiment of the present invention, the location of ring-like segments may be simply and accurately recorded by centrical placement of these segments (in relation to the diametric center of the upper or lower surface of a cymbal, and recording the intersection point of the segment with either the "X" 47, "Y" 49 axis or both. However, since the ring-like segments are formed with definitive diameters which may, of course, also be recorded, recording of such diameters should be sufficient in when centric placement is utilized.

Figure 7:
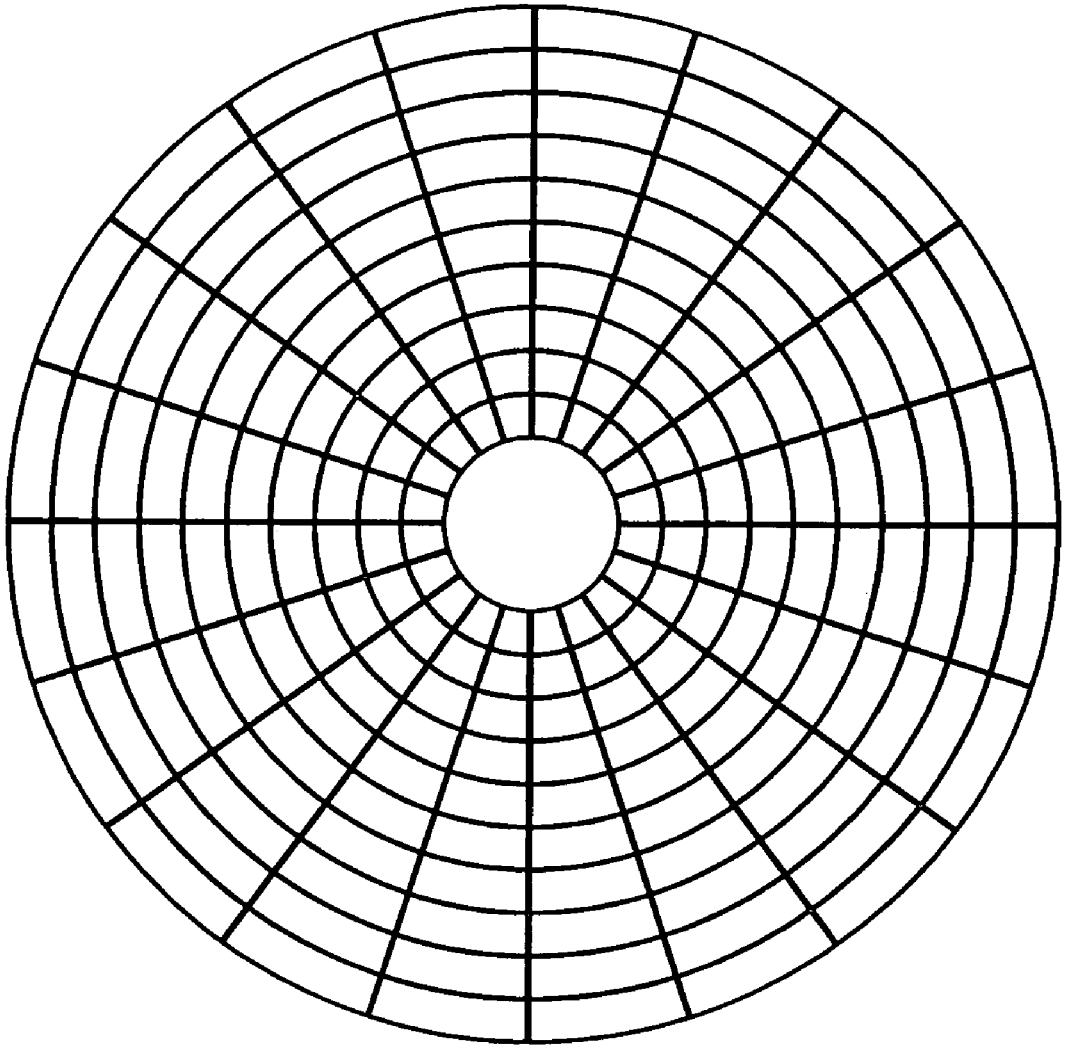
FIG. 7 illustrates a lower surface of a second alternate preferred mapped cymbal of the present invention.
Figure 8A:
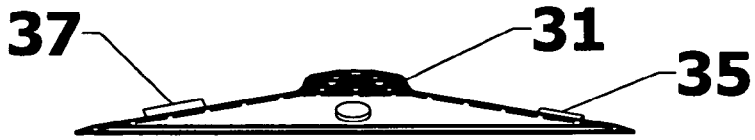
FIG. 8*a*, FIG. 8*b* and FIG. 8*c* are side, top and bottom views—respectively—of an embodiment of applicant's mapped cymbal having mapped upper and mapped lower surfaces
Figure 8B:
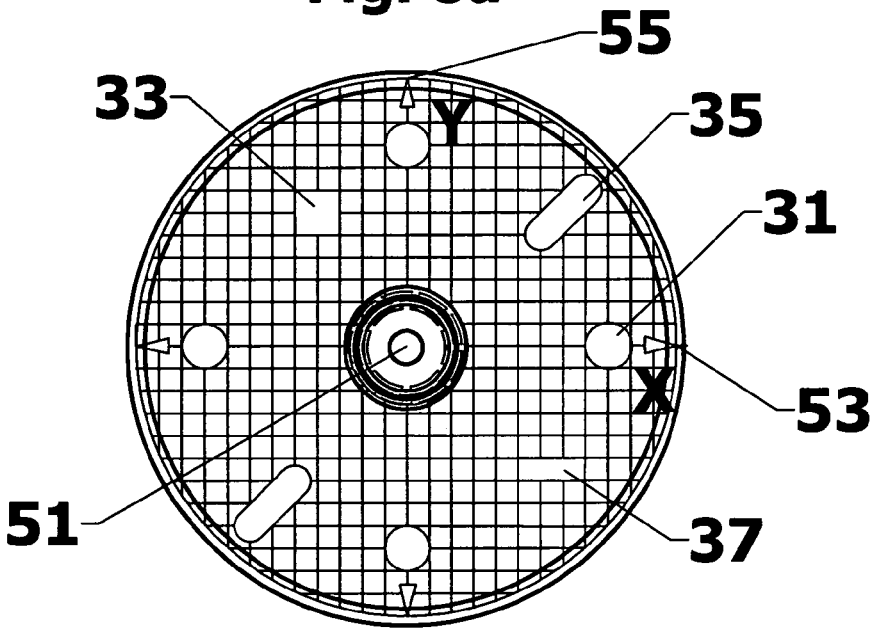
Figure 8C:
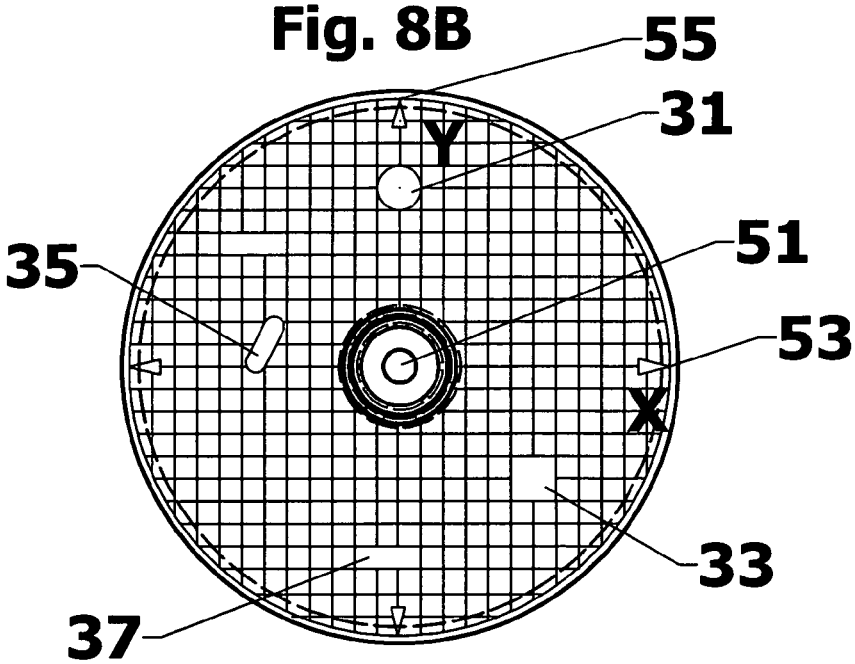

In addition to the aforementioned Cartesian grid mapping, the mapped cymbals of the present invention may include any upper, lower or both upper and lower markings which enable precise and recordable positioning of segments. For example, and, as illustrated in FIG. 7, concentric annular markings in combination with radial lines may provide such mapping when such radial lines and annular markings include identification indicia.

The present invention thus provides, for the first time, a method of placing and recording the placement of sound absorbing and/or vibration damping segments wherein precise segment dimensions and identified composition, in combination with mapped cymbals allows consistent and rapid recreation of desired cymbal tuning.

The terms and expressions which have been employed in the foregoing specification are used therein as terms of description and not limitation, and there is no intention, in the use of such terms and expressions, of excluding equivalents of the features shown and described or portions thereof, it being recognized that the scope of the invention is defined and limited only by the following claims

I claim:

1. A method of optimizing the sound produced by a musical cymbal in a specific performance location comprising:

positioning a cymbal having an upper surface and a mapped lower surface in a specific performance location where said cymbal is to be utilized wherein said mapped lower surface is mapped via visible markings forming a discernible pattern for precise and repeatable placement of sound absorbing segments;

selecting at least one sound absorbing segment comprised of a quantity of sound absorbing material, said segment having a specific length, width, depth and specific shape, at least one surface of said segment having a non-hardening adhesive applied thereto capable of retaining said segment to a surface of a cymbal during playing thereof;

affixing the at least one sound absorbing segment to a selected position located upon the lower mapped surface of the cymbal;

striking the cymbal in such a manner as to produce sound therefrom;

evaluating the sound produced by the cymbal in regard to the volume, frequency and duration;

adjusting the position of the at least one segments until the volume, frequency and duration of sound produced by the cymbal has been tuned in regard to the performance location and music to be played; and recording the position of the at least one sound absorbing segment affixed to the lower mapped surface of the cymbal.

2. The method of claim 1 wherein the musical cymbal is selected from the group consisting of high hat, crash, ride, splash and china cymbals.

3. The method of claim 1 wherein the predetermined shape of the segment is selected from the group consisting of square, rectangular, elongated and circular shapes.

4. The method of claim 1 wherein the predetermined shape of the sound absorbing segment is a ring-like shape especially configured for circumferential placement upon the lower surface of a cymbal.

5. The method of claim 1 wherein the sound absorbing material is a plastic material.

6. The method of claim 5 wherein the plastic material is selected from polyurethane, polyester, polyether and polyvinyl plastic materials.

7. The method of claim 6 wherein the plastic material is a foam material.

8. The method of claim 1 wherein the sound absorbing material is comprised of a felt material.

9. The method of claim 8 wherein the felt material is selected from the group consisting of wool, wool/polyester, rayon, rayon/wool and nylon felts.

10. The method of claim 1 wherein the sound absorbing material is comprised of a rubber compound.

11. The method of claim 10 wherein the rubber compound is selected from the group consisting of natural rubber and nitrile rubber compounds.

12. The method of claim 11 wherein the rubber compound is a foam rubber.

13. The method of claim 1 wherein said sound absorbing material also provides vibration damping.

14. The method of claim 13 wherein the sound absorbing and vibration damping material is comprised of a viscoelastic material.

15. The method of claim 14 wherein the viscoelastic material is comprised of a plastic polymer material.

16. The method of claim 15 wherein the plastic polymer is selected from polyurethane, polyester, polyvinyl and polyether plastic polymer material.

17. The method of claim 13 wherein the sound absorbing and vibration damping material is a composite.

18. The method of claim 17 wherein the composite material is comprised of a plastic polymer material bonded to a metal material.

19. The method of claim 18 wherein the plastic polymer material is selected from the group consisting of polyurethane, polyester and polyether plastic polymers.

20. The method of claim 18 wherein the plastic polymers are foam materials.

21. The method of clam 18 wherein the metal is selected from aluminum, tin, copper, silver and gold.

22. The method of claim 21 wherein the metal material is a metal foil.

23. The method of claim 18 wherein the metal material is a metalized polyester material.

24. The method of claim 18 wherein the composite material is comprised of a three layer composite having two outer metal layers and one middle polymer layer positioned therebetween.

25. The method of claim 13 wherein the upper surface of the cymbal is mapped and wherein the at least one sound absorbing and vibration damping segment is affixed to said mapped upper surface.

26. The method of claim 13 wherein both the upper and lower surface of the cymbal are mapped and wherein sound absorbing vibration damping segments are affixed to both the upper surface and lower surfaces of a cymbal.

27. The method of claim 13 wherein the sound absorbing and vibration damping segment does not include an adhesive layer, the segment demonstrating inherent adhesive qualities sufficient to affix and retain said segment upon a surface of the cymbal without need of an additional adhesive material.

28. The method of claim 1 wherein the upper surface of the cymbal is mapped and wherein the sound absorbing segment is affixed to said mapped upper surface.

29. The method of claim 1 wherein sound absorbing segments are affixed to both the upper and lower surfaces of a cymbal and wherein both the upper and lower surfaces of the cymbal are mapped.

30. The method of claim 1 wherein the segment does not include an adhesive layer, the sound absorbing material demonstrating inherent adhesive qualities sufficient to affix and retain said segment upon a surface of the cymbal without need of an additional adhesive material.

* * * * *